United States Patent [19]

Steiner

[11] Patent Number: 4,513,514

[45] Date of Patent: Apr. 30, 1985

[54] APPARATUS AND METHOD FOR THE HEAT TREATMENT OF YARN

[75] Inventor: Erwin Steiner, Clover, S.C.

[73] Assignee: Technology Consulting Corporation, Charlotte, N.C.

[21] Appl. No.: 487,072

[22] Filed: Apr. 21, 1983

[51] Int. Cl.[3] ..... F26B 3/04

[52] U.S. Cl. ..... 34/24; 34/154; 34/157; 34/242; 28/287

[58] Field of Search ..... 34/23, 24, 147, 154, 34/157, 225, 242; 68/5 D, 5 E, 6; 28/287; 242/47, 47.01, 47.13

[56] References Cited

U.S. PATENT DOCUMENTS

| | | | |
|---|---|---|---|
| 3,426,553 | 2/1969 | Erb | 68/5 |
| 3,683,650 | 8/1972 | Hirschburger | 68/5 D |
| 3,774,384 | 11/1973 | Richter | 57/34 HS |
| 3,972,176 | 8/1976 | Lawson, Jr. et al. | 57/157 TS |
| 4,236,392 | 12/1980 | Sando et al. | 68/5 E |
| 4,277,867 | 7/1981 | Lucke | 28/220 |
| 4,316,370 | 2/1982 | Steiner | 68/5 D |
| 4,320,563 | 3/1982 | D'Agnolo | 28/248 |
| 4,351,118 | 9/1982 | Von Canon et al. | 34/24 |
| 4,411,075 | 10/1983 | Blaudszun | 34/242 |
| 4,414,756 | 11/1983 | Simpson et al. | 68/5 D |

*Primary Examiner*—Larry I. Schwartz
*Assistant Examiner*—David W. Westphal
*Attorney, Agent, or Firm*—Bell, Seltzer, Park & Gibson

[57] ABSTRACT

An energy efficient apparatus and method for the continuous heat treatment of a carpet yarn or the like is disclosed, and which includes a conveyor extending through a heat treatment chamber, and with the conveyor comprising a number of endless belts which are adapted to support the yarn in downwardly hanging relaxed helically arranged loops. The lower portions of the loops are supportingly lifted during movement through each of the entrance and exit openings of the chamber, which permits the dimensions of the openings in the chamber to be minimized and thereby reduce heat loss therethrough. Also, exhaust enclosures are provided adjacent each of the entrance and exit openings to prevent the entry of outside room air through the openings and into the chamber, and means are provided for subjecting the lower portions of the loops to an extra application of heated air and steam within the chamber for neutralizing the possible cooling effect of any outside cool air which may move into the chamber through the lower portions of the entrance and exit openings. Means are provided for substantially uniformly circulating heated air and steam through all portions of the loops as they move through the chamber and means are also provided whereby the operative runs of the upper supporting belts of the conveyor move laterally with respect to the loops during movement through the chamber to avoid the heat setting of bends or kinks in the yarn at the support points.

21 Claims, 18 Drawing Figures

APPARATUS AND METHOD FOR THE HEAT TREATMENT OF YARN

The present invention relates to an energy efficient apparatus and method for the continuous heat treatment of yarn, and which is characterized by the ability to ensure that all portions of the yarn are treated under substantially uniform conditions to thereby provide a high degree of uniformity in the finished product.

Applicant's prior U.S. Pat. No. 4,316,370 and copending U.S. application Ser. No. 421,865, disclose a continuous yarn heat setting machine which comprises a plurality of separate conveyors for continuously conveying a number of yarns through a heat treatment chamber. Each conveyor comprises four belts arranged in a rectangular pattern when viewed in cross section, and a yarn winding flyer is provided at the entry end of each conveyor for winding a running yarn into downwardly hanging helical loops around the periphery of the four belts. The belts of each conveyor are advanced in unison through the heating chamber, and so that the yarn is conveyed in a relaxed, downwardly hanging looped configuration.

In order to permit the yarn loops to freely shrink during their passage through the treatment chamber, the belts of the conveyors are guided to move inwardly toward each other just prior to entering the heat treatment chamber, and so as to provide a reduced circumferential dimension. Thus the yarn loops tend to relax and drape downwardly to form relatively long free hanging extensions which extend below the belts as the loops move through the entrance opening of the chamber.

Continuous yarn heat setting machines of the described type incorporate a steam heating system which is necessarily open or non-pressurized because of the fact that the yarn transfer conveyors each extend through openings at the entrance and exit ends of the treatment chamber. In addition to the loss of steam through these openings, a substantial amount of cool room air enters the chamber through these openings, which causes undesirable condensation within the chamber. In addition, the cool room air flows primarily through the lower portion of the openings, and thus it acts to excessively cool the lower portions of the yarn loops. This cooling of the lower portions of the loops can result in difficulties in the processing of many types of yarn, such as nylon carpet yarn, since in such cases it is important that all portions of the yarn receive equal heat treatment and are free to shrink equal amounts. As is well understood, different shrinkage in different portions of the yarn can result in visible and unsightly streaks in the finished carpet, and the excessive cooling of the lower portions of the loops thus renders the uniform heating of the yarn in the chamber more difficult. These problems of loss of steam from the chamber and entry of cool outside air are aggravated by the fact that the lower edge of the openings in the chamber must be lowered a distance sufficient to accommodate the downward drape of the relaxed yarn loops on the conveyor.

To alleviate the problem of cool air moving into the chamber through the lower portions of the entrance and exit openings, it has heretofore been proposed to position exhaust enclosures within the chamber and adjacent the openings, for drawing off the outside air which moves through the openings. In addition, it has been proposed to utilize a steam circulation system employing perforated covers for the conveyors, in an attempt to obtain more uniform contact of the heated air and steam with the yarn in the chamber. While these arrangements provide improved results, they do not totally avoid the problems in all instances.

A further limitation associated with prior continuous yarn heat setting machines of the described type is the fact that certain polymeric yarns, e.g. polyester yarn, tend to heat set and form a permanent bend or "kink" in the yarn at each of the points where the loops are supported by the two upper belts during their movement through the treatment chamber. These bends or kinks render the yarn non-uniform and can produce imperfections in a finished carpet or other fabric.

With the above considerations in mind, it is an object of the present invention to provide an energy efficient apparatus and method for heat treating yarn in downwardly hanging loop form.

It is a more particular object of the present invention to provide an apparatus and method of the described type, and which minimizes loss of steam through the end openings of the treatment chamber, and which also reduces the amount of cool room air entering the chamber through the end openings.

It is a further object of the present invention to provide an apparatus and method for heat treating a yarn in loop form, and which is able to direct heated air and steam into contact with the advancing loops in a manner which ensures substantially uniform treatment of all portions of the yarn loops.

It is another specific object of the present invention to provide an apparatus and method of the decribed type which effectively avoids the formation of heat set bends or kinks in the yarn.

These and other objects and advantages of the present invention are achieved in the embodiment illustrated herein by the provision of an apparatus and method which includes a yarn heat treatment chamber, and a yarn conveyor extending through the chamber for advancing a running yarn therethrough while supporting the yarn in downwardly hanging, relaxed helically arranged loops. A winder may be positioned adjacent the upstream end of the conveyor for winding a running yarn onto the conveyor and a take-up winder may be positioned adjacent the downstream end for withdrawing the loops of yarn from the conveyor and winding the yarn into finished packages. In addition, the preferred embodiment of the apparatus includes yarn loop support means underlying the conveyor at least adjacent each of the entrance and exit openings of the chamber, for supporting and lifting the lower portions of the loops as they move through the openings to thereby reduce the vertical dimension of the loops without reducing the circumferential extent thereof. Thus the vertical dimension of each of the entrance and exit openings may thus be sized to be only slightly greater than the vertical dimension of the loops as they move therethrough. The resulting reduction in the height of the openings has been found to significantly reduce the entry of outside air into the chamber, and loss of steam, as compared to conventional heat treatment chambers of this type.

The treatment chamber of the present invention is further provided with an internal heating and air distribution system which is able to direct the heated air and steam into substantially uniform contact with all portions of the yarn loops. This heating system includes a novel perforated cover overlying substantially the entire length of the yarn conveyor means within the chamber. The cover is of generally inverted U-shape in cross section to define a top wall and opposite depending side walls, and the top wall includes a plurality of transverse rows of perforations. Each of the side walls also includes a plurality of transverse rows of perforations, with the rows on the side walls being longitudinally spaced from the rows in the top wall. The heated air and steam are circulated within the chamber so as to pass through the perforations of the cover, and such that the air and steam substantially equally contacts all portions of the yarn loops.

To neutralize the cooling effect on the lower portions of the loops at the entrance and exit openings in the chamber caused by cool room air which may move into the chamber, the preferred embodiment of the invention further includes an exhaust enclosure immediately adjacent the outside of each of the entrance and exit openings, and a blower for exhausting air from each of the enclosures, whereby outside air is effectively prevented from entering the chamber through the openings. Also, there is provided jacket means surrounding the conveyor at each of the entrance and exit openings of the chamber for guiding the circulating heated air and steam directly into contact with primarily only the lower portions of the yarn loops. This extra heating of the lower portions serves to counteract the cooling effect of any room air passing through the adjacent opening, and thus the lower portions receive essentially the same overall heat treatment as do the remaining portions of the loops, to thereby achieve substantially uniform heat treatment.

As a further important aspect of the present invention, guide pulleys are provided for the two upper ones of the four endless belts of the conveyor, with the guide pulleys being positioned such that there is a relatively small lateral spacing between the operative runs of the belts adjacent the entrance opening, and a gradually increasing lateral spacing of the runs through the chamber. By this arrangement, the operative runs move laterally outwardly with respect to the upper portions of the supported loops of yarn during movement through the chamber, to thereby avoid the formation of permanent kinks in the loops.

Some of the objects and advantages of the invention having been stated, others will appear as the description proceeds, when taken in connection with the accompanying drawings, in which FIG. 1 is a partly sectioned side elevation view of an apparatus embodying the features of the present invention;

Figure 1:
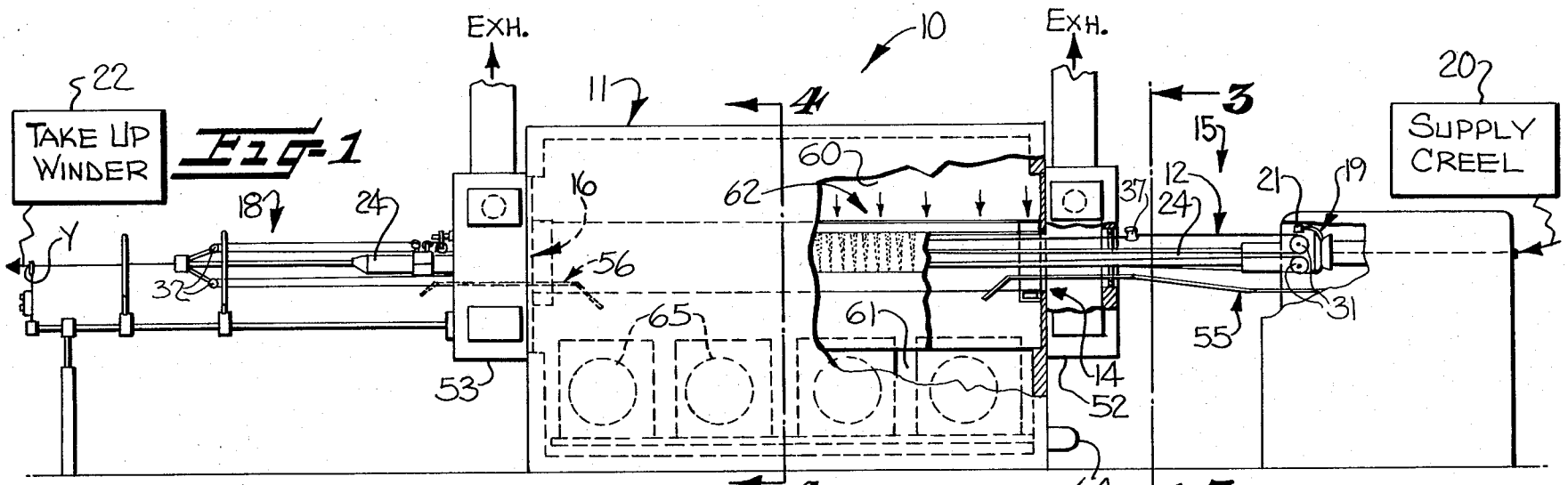
Figure 2:
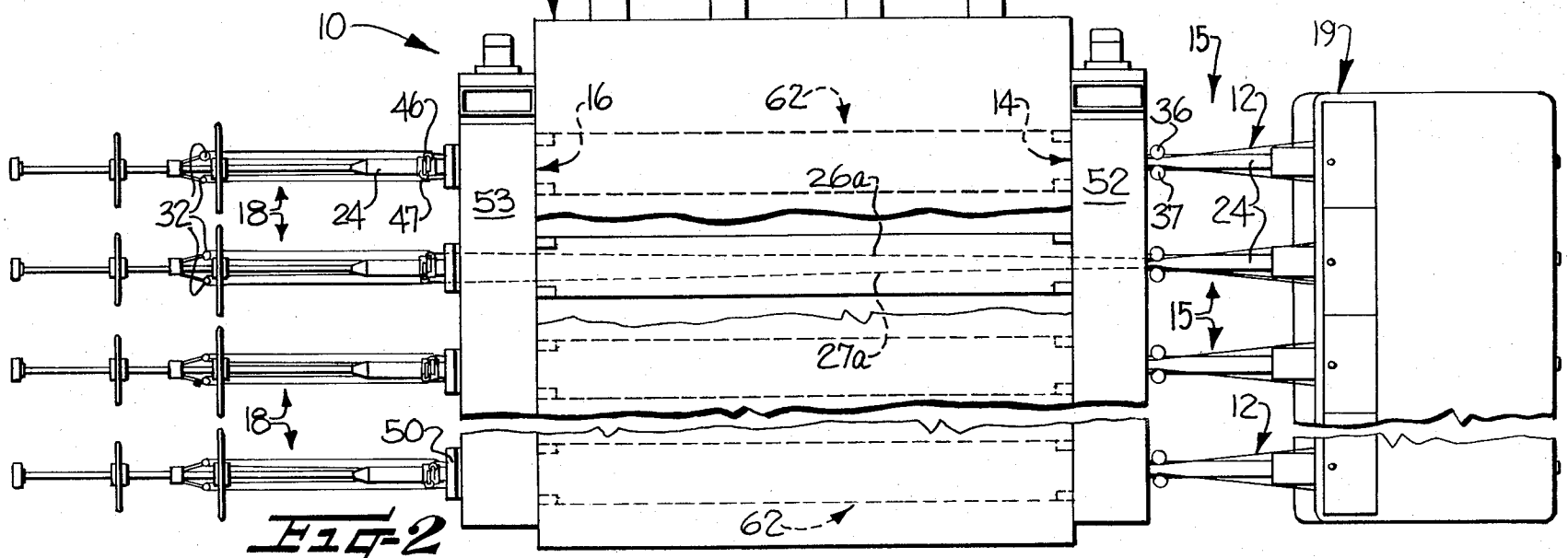
FIG. 2 is a top plan view of the apparatus shown in FIG. 1, with parts broken away.
Figure 3:
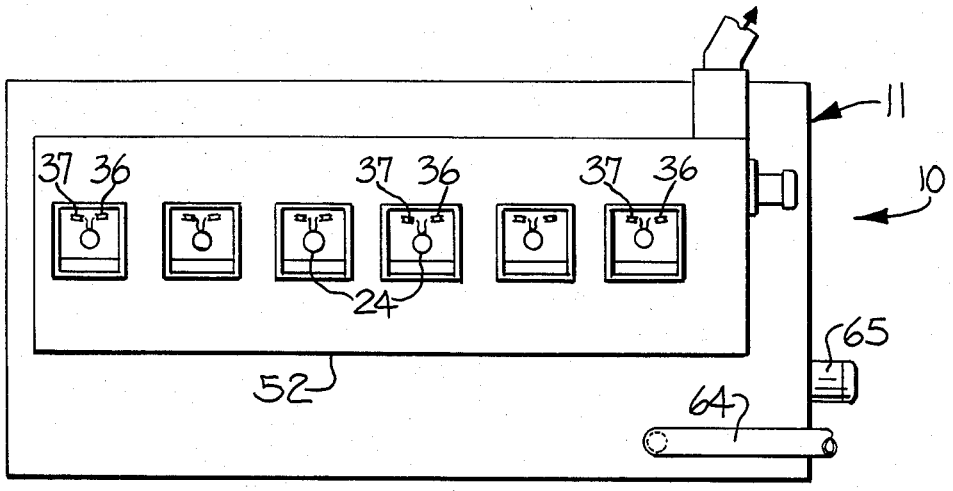
FIG. 3 is a sectioned front elevation view taken substantially along the line 3—3 of FIG. 1.

Referring more particularly to the specific embodiment of the invention disclosed in the drawings, there is illustrated a yarn heat setting apparatus 10 which comprises a heat treatment chamber 11 through which the yarn Y to be treated is conveyed. The chamber 11 is adapted to be heated by steam or the like, to a temperature in a range of between about 190–220 degrees C., in a manner further described below.

In the illustrated embodiment, a total of six yarn conveyors 12 extend horizontally through the chamber 11. More particularly, the chamber 11 includes six entrance openings 14 in one end wall, and six exit openings 16 in the opposite end wall, and each conveyor 12 extends through an aligned pair of respective entrance and exit openings. Each conveyor 12 includes a portion 15 disposed upstream of the chamber, and each conveyor extends for a distance beyond the heating chamber in the downstream direction to define an accummulation zone 18.

The upstream end of the apparatus includes a winding machine 19 for withdrawing the yarns Y from a creel 20 and helically winding one or more running yarns onto each conveyor at a yarn receiving zone 17 (FIG. 13) on the upstream portion 15. The winding machine 19 is generally conventional, and includes a flyer 21 for each conveyor which rotates about the axis of the conveyor so as to deposit the running yarn thereabout. A yarn takeup winder 22 is disposed downstream of the chamber 11 for withdrawing the yarn from the accumulation zone of each conveyor, and winding the yarn into finished packages.

Each conveyor 12 is composed of a central mast 24 which is suitably supported adjacent the upstream end of the conveyor within the winding machine 19, and which extends in cantilever fashion along the entire length of the conveyor. Four endless belts 26, 27, 28, 29 are supported on the mast, and are arranged in a rectangular pattern in cross section. Each belt is rotatably mounted about a pair of rollers 31, 32 which are carried by the mast 24, and the four downstream rollers 32 are mounted for radial adjustment by means of the telescoping mechanism, whereby the size of the rectangular arrangement at the accumulation zone 18 may be varied. The belts are driven in unison by a suitable drive mechanisms(not shown), to advance the loops of yarn therealong and in the manner further described below.

Figures 13, 14, 15:
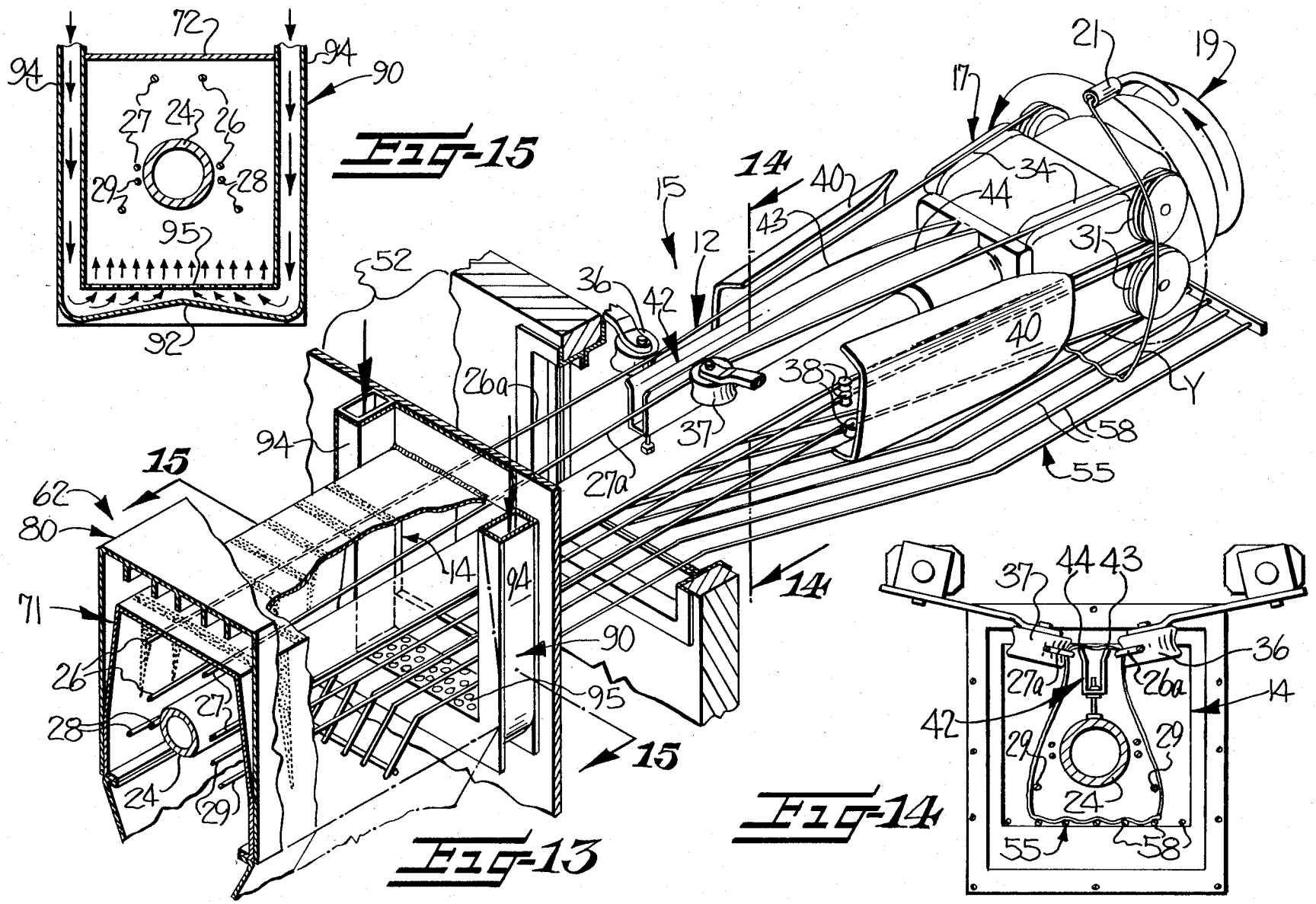
FIG. 13 is a fragmentary and partially sectioned perspective view showing the upstream end portion of the yarn conveyor of the present invention.
FIG. 14 is a sectional view taken substantially along the Line 14—14 of FIG. 13.
FIG. 15 is a sectional view of the steam guide jacket and taken substantially along the line 15—15 of FIG. 13.

As best seen in FIG. 13, each conveyor 12 includes guide runners 34 which are disposed to underlie the outer run of each belt at the yarn receiving zone 17. The guide runners 34 thereby maintain the separation of the belts at a fixed predetermined distance at the point at which the yarn is received, which typically is set so that the circumferential distance about the belts is about one meter. Downstream of the yarn receiving zone 17, there is provided a guide pulley for each run of the four belts and which are positioned to contract the runs toward each other and thereby reduce the effective circumferential distance about the four belts. More particularly, the two guide pulleys 36, 37 are mounted to the chamber for engaging the upper runs 26*a*, 27*a* of the two upper belts, 26, 27, and the smaller guide pulleys 38 are provided for engaging respective ones of the remaining runs.

A pair of guide plates 40 are disposed on opposite sides of the mast 24 immediately downstream of the yarn receiving zone 17 and overlying the guide rollers 38. The guide plates 40 are designed to support the side portions of the advancing loops and prevent their contact with the returning runs of the belts.

Figure 9:
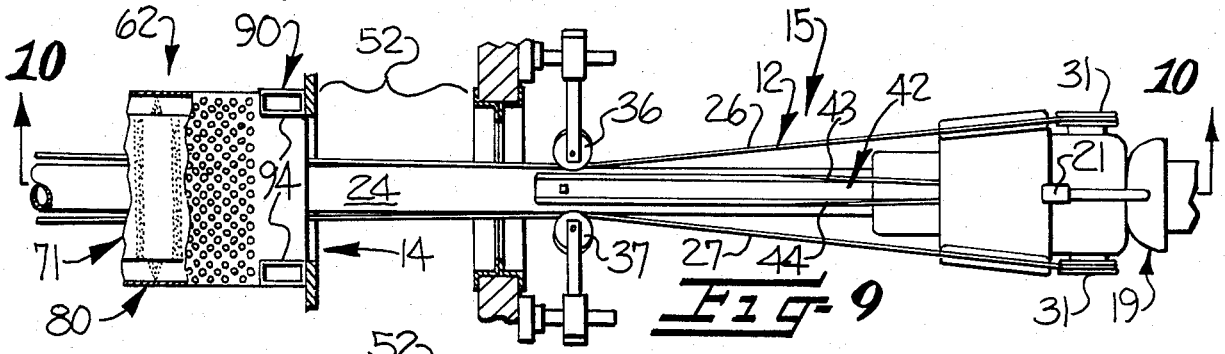
FIG. 9 is a fragmentary top plan view of the upstream end portion of the yarn conveyor of the present invention.
Figure 10:
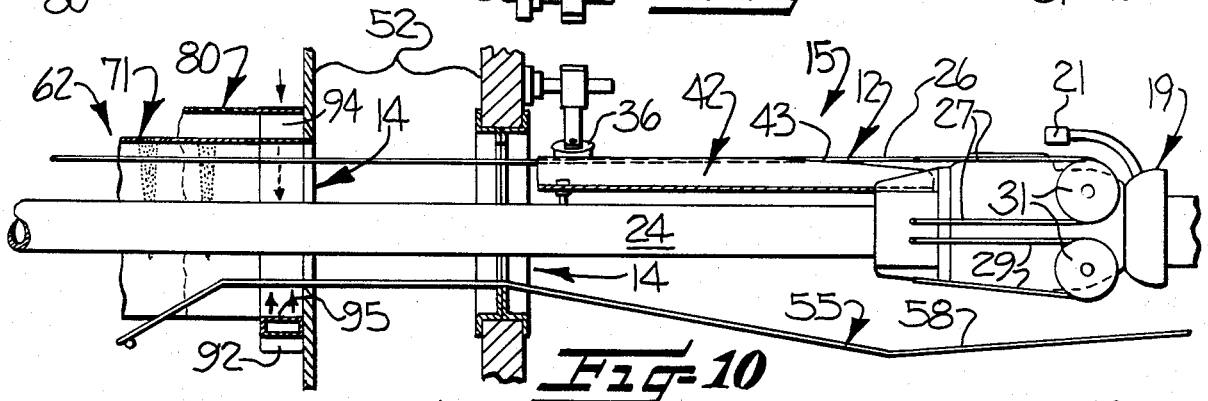
FIG. 10 is a fragmentary side elevation view of the upstream end portion of the conveyor.

The two operative runs 26*a*, 27*a* of the upper belts 26, 27 will be seen to move laterally toward each other as they move from the yarn receiving zone 17 to the entrance opening 14. Yarn engaging means in the form of a U-shaped channel 42 is mounted so as to extend longitudinally between the two operative runs 26*a*, 27*a* and to prevent any significant drape in that portion of the loops extending between such runs. More particularly, the channel 42 defines a pair of longitudinally extending surfaces 43, 44 which are between the operative runs at an elevation so as to contact the yarn, and the surfaces 43, 44 diverge from each other as they approach the pulleys 36, 37, note FIG. 9. Thus the diverging surfaces 43, 44 tend to urge the engaged upper portions of the loops laterally toward the runs 26*a*, 27*a* so that the runs move laterally inwardly with respect to the yarn loops and any significant drape of the yarn therebetween is thereby effectively precluded.

An additional pair of guide pulleys 46, 47 is mounted to the mast 24 adjacent the exit opening 16 of the chamber for engaging the inside edges of the upper runs 26*a*, 27*a* of the belts 26, 27. By design, the lateral spacing of the downstream guide pulleys 46, 47 is greater than the lateral spacing of the upstream guide pulleys 36, 37, and thus the lateral spacing of the upper runs gradually increases during movement through the chamber. This results in the upper runs 26*a*, 27*a* moving laterally outwardly with respect to the upper portions of the supported loops of yarn during movement through the chamber, which serves to avoid the formation of permanent heat set kinks in such loops, since no portion of the yarn will be supported by the runs in a bent configuration for any appreciable amount of time within the chamber.

Figure 11:
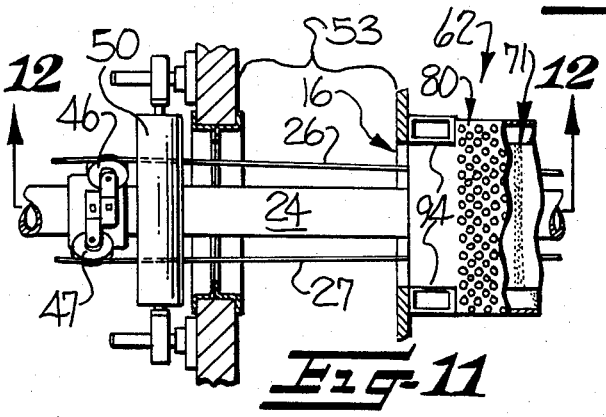
FIG. 11 is a fragmentary top plan view of the portion of the conveyor passing through the exit opening of the heating chamber.
Figure 12:
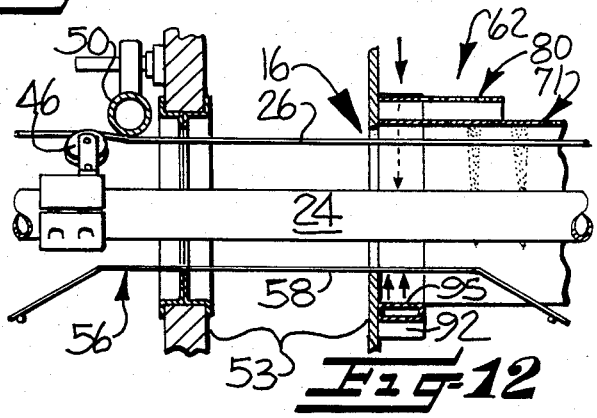
FIG. 12 is a fragmentary side elevation view of the portion of the conveyor shown in FIG. 11.
Figure 16:
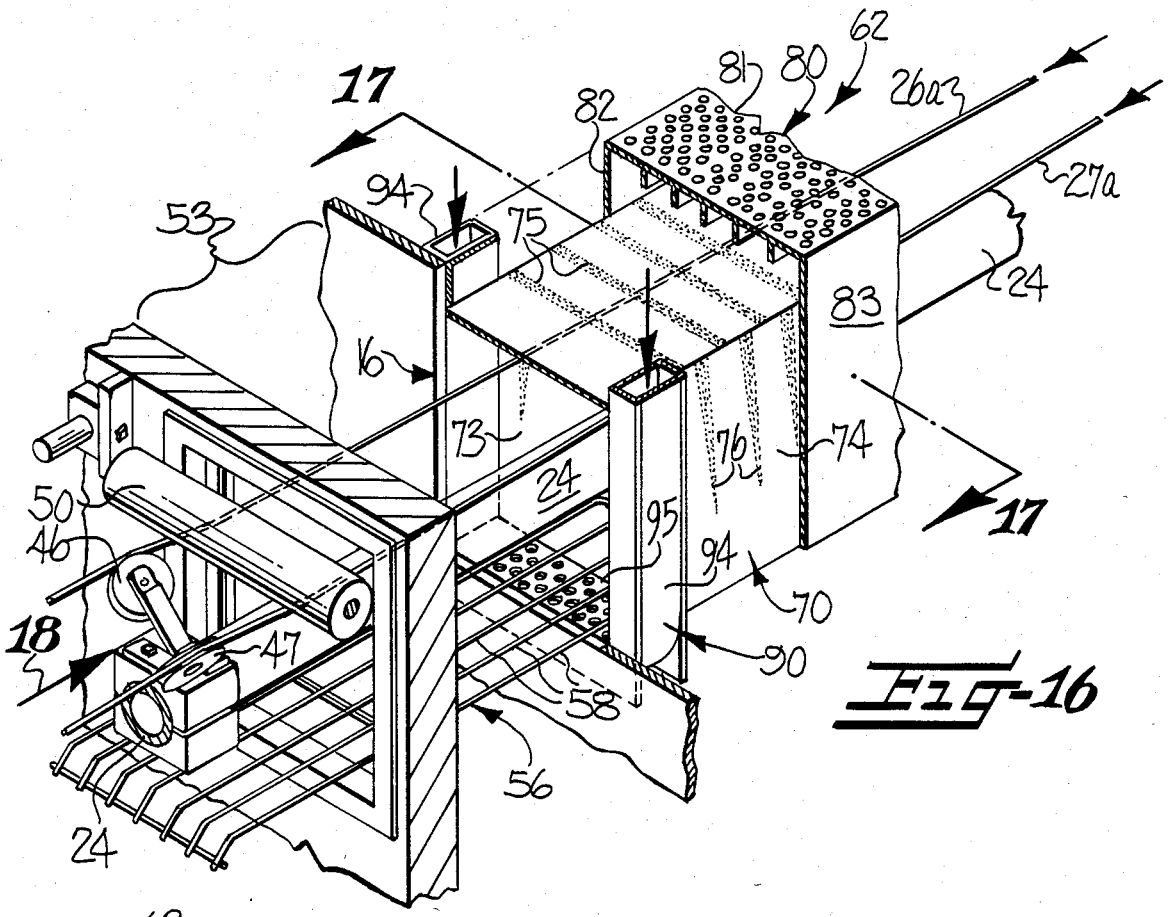
FIG. 16 is a fragmentary partly sectioned view of the portion of the conveyor which passes through the exit opening of the apparatus.

The belt guide means of the preferred embodiment of the apparatus further includes a roller 50 mounted to the chamber 11 and disposed in alignment with the upper edge of each exit opening 16, and so as to lie immediately upstream of the guide pulleys 46, 47, note FIGS. 11, 12 and 16. As will be understood, the downstream end of the cantilevered conveyor 12 will tend to slightly drop under the weight of the yarn, and the downstream end is movable with respect to the exit opening 16. The roller 50 is positioned so that the operative runs 26*a*, 27*a* of the upper belts 26, 27 engage the roller 50 rather than the upper edge of the opening 16 upon upward movement of the conveyor, to thereby avoid any possible contact between the upper portions of the loops of yarn with the upper edge. The roller 50 also serves to firmly hold the upper runs 26*a*, 27*a* in proper engagement with the pulleys 46, 47.

The illustrated yarn treatment chamber further includes an exhaust enclosure 52 mounted on the outside of the upstream end wall and surrounding all of the entrance openings 14 of the chamber. A similar exhaust enclosure 53 is mounted on the outside of the downstream end wall and encloses all of the exit openings 16. A blower (not shown) is associated with each of the enclosures 52, 53, for drawing a partial vacuum therewithin. Thus a small amount of the heated air and steam is withdrawn outwardly through the entrance and exit openings, and outside air is effectively prevented from entering the chamber through the openings.

Figure 18:
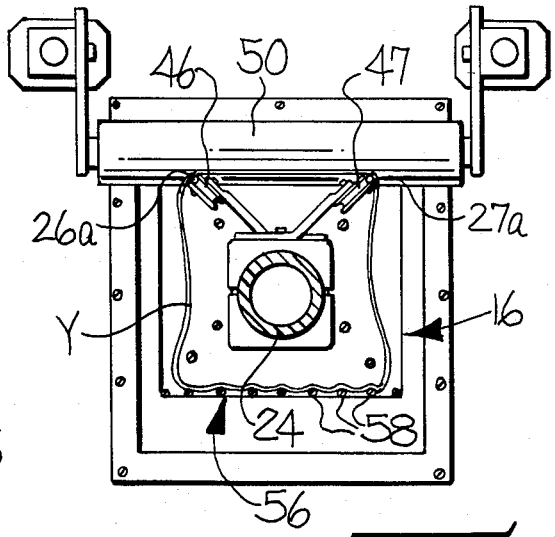
FIG. 18 is a fragmentary sectional end view taken along the direction of arrow 18 in FIG. 16.

In accordance with the present invention, each conveyor 12 includes yarn loop support means 55, 56 which extend through respective ones of the exhaust enclosures 52, 53 and associated openings, and underlie the conveyor. Each of the loop support means lifts and supports the lower downwardly hanging portions of the loops as they move through the enclosures and openings, to thereby reduce the vertical dimension of the loops without reducing the circumferential extent thereof, note FIGS. 14 and 18. Thus the vertical dimension of each of the entrance and exit openings is sized so as to be not substantially greater than the vertical dimension of the loops as they move therethrough, to thereby minimize the loss of heated air through the openings and the entry of outside air into the chamber. In the illustrated embodiment, the yarn loop support means 55 at the upstream end of the conveyor extends from a point underlying the yarn receiving zone 17, and comprises a plurality of generally parallel, laterally spaced apart metal rods 58 which extend through the enclosure 52 and the opening 14. The downstream loop support means 56 comprises a similar structure and extends from a point immediately upstream of the exit opening and through the enclosure, note FIGS. 12 and 16. If desired, the loop support means 55, 56 could extend entirely through the treatment chamber, in which event any tension in the lower portions of the loops caused by the weight of the yarn will be reduced, which may facilitate the unrestricted shrinking and bulking thereof in the case of certain yarns.

Figure 4:
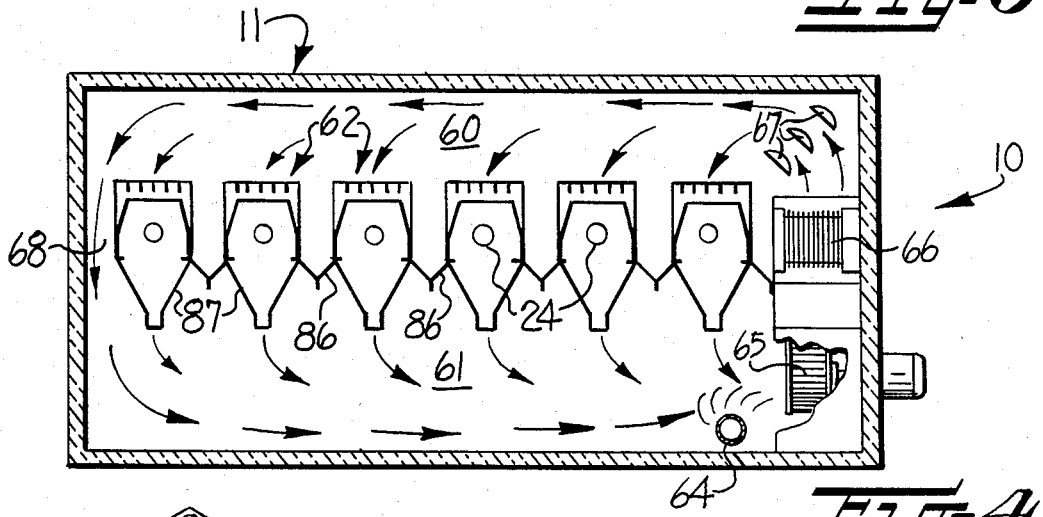
FIG. 4 is a view similar to FIG. 3 and taken substantially along the line 4—4 of FIG. 1.

The interior of the chamber 11 includes means for circulating heated air and steam within the chamber and into contact with the yarn loops being conveyed therethrough. As best seen in FIG. 4, the interior of the chamber is divided horizontally into an upper section 60 and a lower section 61 by interconnected cover means 62 for the six conveyors. The heating and circulating means includes a steam inlet pipe 64 opening into the lower section 61, and a plurality of blowers 65 for circulating the heated air and steam upwardly into the upper section 60 and through an auxiliary heater 66. The upwardly moving airstream is then guided horizontally over the cover means 62 by the baffles 67, and the airstream then moves downwardly through the cover means 62, past the conveyors 12, and back into the lower section 61. If desired, an adjustable open space 68 may be provided at the far side of the cover means 62 for controlling the amount and distribution of the airstream through the cover means.

Figure 8:
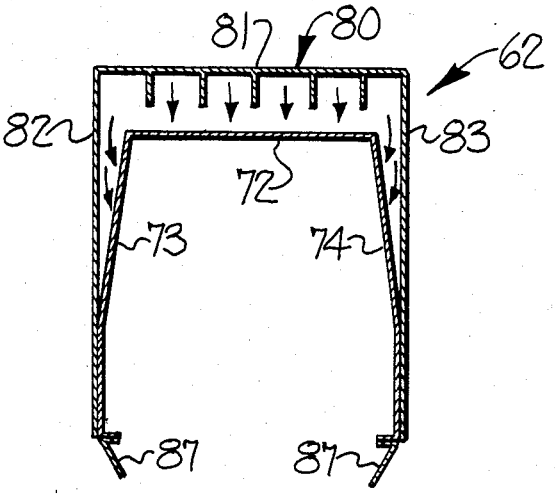
FIG. 8 is an end view of the covers shown in FIG. 7.

The portion of the cover means 62 associated with each conveyor includes a first or inner cover 71 of generally inverted U-shape in cross section so as to define a top wall 72 and opposite depending side walls 73, 74. The top and side walls essentially enclose the conveyor 12 in cross section, and the top wall includes a plurality of transverse rows of apertures 75 and each of the side walls includes a plurality of transverse rows of apertures 76, with the rows 76 on the side walls being longitudinally spaced from the rows 75 in the top wall. The side walls are flared outwardly from each other along the upper portion of their height at an angle of about 6° from a line which is perpendicular to the plane of the top wall 72, and they include lower portions which are parallel to such line, note FIG. 8.

The cover means 62 further includes a second or outer cover 80 enclosing the first cover 71 with the outer cover 80 including a perforated top wall 81 and depending parallel side walls 82, 83. The outer cover 80 overlies the first cover, with the top wall 81 of the outer member 80 being parallel to the top wall 72 of the inner cover 71. Five baffles 84 are positioned to extend longitudinally along the inside of the top wall 81 of the outer cover 80, for guiding the air vertically toward the inner cover 71. Also, the outward flare of the side walls 73, 74 of the inner cover 71 results in the adjacent side walls of the two covers converging toward each other, with the lower portions of the side walls 73, 74 contacting the lower portions of the associated side walls 82, 83 of the outer cover in the manner best seen in FIG. 8. Closure panels 86 are positioned between the outer covers of adjacent conveyors to close the space therebetween, and outlet guide panels 87 are fixed to the side walls of the covers and are disposed in a V-shaped arrangement below each of the conveyors.

Figure 5:
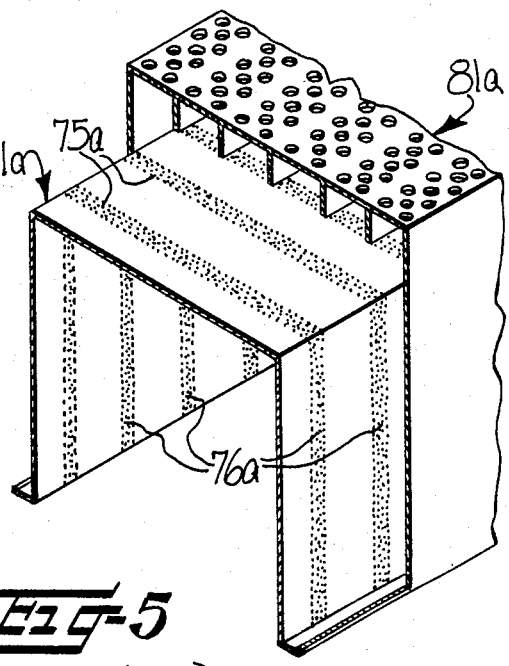
Fig-5 (PRIOR ART)
FIG. 5 is a fragmentary perspective view of inner and outer covers for a yarn conveyor of a type used in the prior art.
Figure 6:
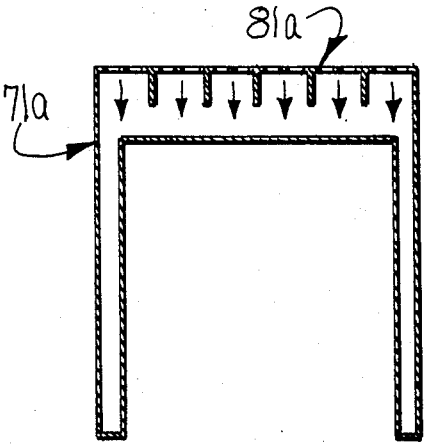
Fig-6 (PRIOR ART)
FIG. 6 is an end view of the covers shown in FIG. 5.
Figure 7:
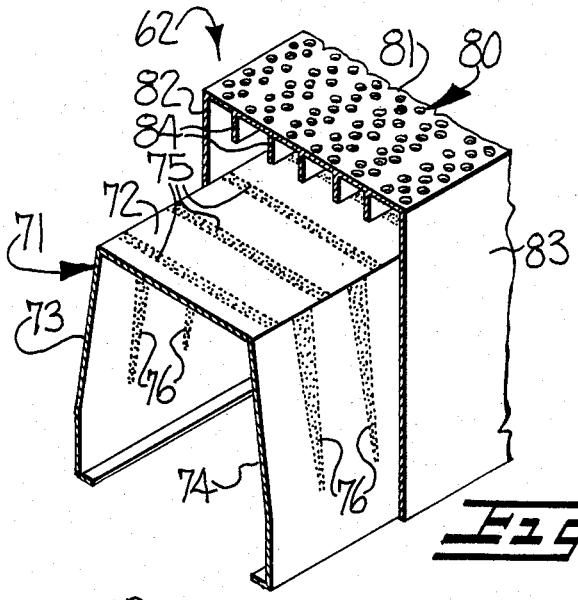
FIG. 7 is a fragmentary perspective view of inner and outer covers for a yarn conveyor in accordance with the present invention.

FIGS. 5 and 6 illustrate the type of inner and outer covers 71*a*, 80*a* as heretofore utilized in prior yarn heat treating apparatus of this general type. As therein illustrated, the top wall and side walls of the inner cover 71*a* were disposed at right angles to each other, and the rows of perforations in the top and side walls were aligned. This prior construction did not provide the desired degree of uniformity in the distribution of heated air and steam through all portions of the loops, specifically in that the lower portions of the loops often received inadequate contact and thus would shrink to a lesser degree. Also, the spacing between the adjacent side walls of the inner and outer covers was difficult to control, and non uniform spacing could cause non uniform distribution of the circulating air and steam.

Figure 17:
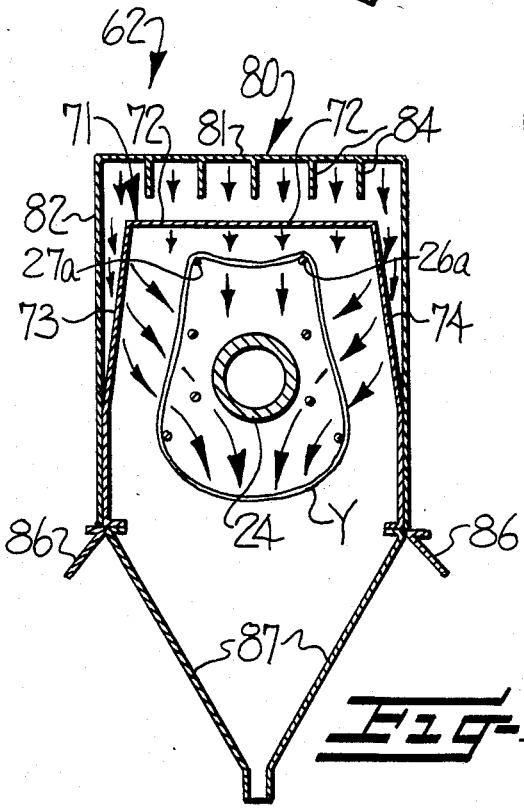
FIG. 17 is a sectional view of the conveyor and taken substantially along the line 17—17 of FIG. 16.

The configuration and arrangement of the side walls and apertures of the cover 71 of the present invention is seen to provide substantially improved uniformity in treatment. In particular, it has been found that the tapered space between the adjacent side walls of the inner and outer covers serves to increase the flow through the side walls, and it avoids the problem of uniform spacing between the adjacent side walls. In addition, longitudinally offsetting the apertures in the side walls from the apertures in the top wall assures that the air and steam entering through the side wall is able to move inwardly into contact with the sides of the loops, and then downwardly through the lower portions, without being initially deflected downwardly by the air and steam entering through the perforations in the top wall, note FIG. 17. Thus with the present invention, the air and steam entering through the side walls 73, 74 is able to fully contact the sides and bottom portions of the loops.

While the use of the exhaust enclosures 52, 53 as described above is believed to minimize the entry of cool room air into the chamber, it is possible in certain instances that some cool air will nonetheless move through the lower portion of both the entrance and exit openings. This cool airstream will move across the lower portions of the loops, and will tend to delay the lower portions from coming into contact with the heated interior air and steam. In accordance with the present invention this cooling effect may be neutralized by the provision of a guide jacket 90 mounted adjacent each of the entrance and exit openings, and which is designed to direct the circulating air and steam into contact with the lower portions of the yarn loops passing therethrough. As best seen in FIGS. 13, 15 and 16, each guide jacket 90 comprises a hollow U-shaped bracket fixed to the inside of the end wall of the chamber, and which is composed of a horizontal bottom section 92 and opposite upright side extensions 94. The upper ends of the side extensions 94 are open to receive the circulating air and steam, and the upper surface 95 of the bottom section is perforated so that the air and steam is directed upwardly into immediate contact with the adjacent lower portions of the loops as they move thereacross. The adjacent end portions of the cover 71 do not include apertures, so that the lower portions of the loops are subjected to an extra application of heated air and steam, as compared to the remaining portions of the loops. As a result, the cooling effect of the entering air is neutralized, and all portions of the loops receive in total a substantially balanced application of heated air and steam.

In the drawings and specification, there has been set forth a preferred embodiment of the invention, and although specific terms are employed, they are used in a generic and descriptive sense only and not for purposes of limitation.

That which is claimed is:

1. An energy efficient apparatus for heat treating a running yarn, and comprising a yarn treatment chamber, including an entrance opening in one end wall, an exit opening in the opposite end wall, and means for heating the interior thereof, yarn conveyor means extending through said chamber and through said entrance and exit openings for advancing a running yarn therealong and while supporting the yarn in downwardly hanging, relaxed helically arranged loops, and yarn loop support means underlying said conveyor means at least adjacent each of said entrance opening and said exit opening, for supporting and lifting the lower portions of the loops as they move through said openings to thereby reduce the vertical dimension of the loops without reducing the circumferential extent thereof, and so that the vertical dimension of each of said entrance and exit openings is not substantially greater than the vertical dimension of the loops as they move therethrough to thereby minimize the loss of heat through the openings and the entry of outside air into the chamber.

2. The apparatus as defined in claim 1 wherein said yarn treatment chamber further includes means mounted adjacent at least one of said entrance and exit openings for directing heated air and steam into contact primarily with the lower portions of the yarn loops passing therethrough to thereby neutralize the cooling effect of any outside air passing into the chamber through the lower portion of such opening.

3. The apparatus as defined in claim 1 or 2 wherein said yarn treatment chamber further includes an exhaust enclosure mounted immediately adjacent each of said entrance and exit openings, and blower means for exhausting air from each of said enclosures, whereby outside air is effectively prevented from entering said chamber through said entrance and exit openings.

4. The apparatus as defined in claim 3 wherein said conveyor means comprises four endless belts arranged in a rectangular pattern in cross section, and means for advancing the belts in unison.

5. The apparatus as defined in claim 4 wherein said yarn loop support means comprises a plurality of generally parallel, laterally spaced apart rods mounted to said treatment chamber and extending through each of said exhaust enclosures.

6. The apparatus as defined in claim 5 further comprising perforated cover means overlying substantially the entire length of said yarn conveyor means within said chamber, and means for circulating heated air and steam within the chamber and through said cover means, whereby the air and steam are directed through said cover means and into contact with the yarn loops.

7. The apparatus as defined in claim 6 wherein said cover means includes a cover of generally inverted U-shape in cross section to define a top wall and opposite depending side walls, said top and side walls essentially enclosing said conveyor means in cross section, and said top and side walls being perforated in a predetermined pattern to admit a controlled distribution of heated air and steam therethrough and substantially equalize the temperature and amount of heated air and steam contacting all portions of the yarn loops.

8. The apparatus as defined in claim 4 further comprising belt guide means operatively associated with the two upper ones of said four endless belts of said conveyor means for providing a relatively small lateral spacing between the operative runs of said belts adjacent said entrance opening and a gradually increasing lateral spacing of such runs through said chamber and to a point adjacent said exit opening.

9. An energy efficient apparatus for heat treating a running yarn, and comprising a yarn treatment chamber, including an entrance opening in one end wall, an exit opening in the opposite end wall, and means for heating the interior thereof, yarn conveyor means extending through said chamber and through said entrance and exit openings for advancing a running yarn therealong and while supporting the yarn in downwardly hanging, relaxed helically arranged loops, cover means overlying substantially the entire length of said yarn conveyor means within said chamber, said cover means including an inner cover of generally inverted U-shape in cross section to define a top wall and opposite depending side walls, said top and side walls essentially enclosing said conveyor means, and said top wall including a plurality of transverse rows of apertures, and each of said side walls including a plurality of transverse rows of apertures, with the rows on said side walls being longitudinally spaced from the rows in said top wall, and an outer cover enclosing said inner cover and yarn conveyor means, said outer cover including an apertured top wall disposed parallel to and immediately above said top wall of said inner cover, and nonapertured generally parallel side walls, and wherein said side walls of said inner cover each include outwardly flared portions and such that the outwardly flared portions converge toward and contact the associated side wall of said outer cover, means for circulating heated air and steam within said chamber and through said cover means, whereby the heated air and steam pass through said outer cover and then through said inner cover so as to provide a controlled distribution of heated air and steam therethrough which substantially equalizes the temperature and amount of heated air and steam contacting all portions of the yarn loops to thereby achieve substantially uniform heat treatment.

10. The apparatus as defined in claim 9 further comprising means mounted adjacent each of said entrance and exit openings for directing heated air and steam primarily into contact with the lower portions of the yarn loops passing therethrough, an exhaust enclosure mounted immediately adjacent each of said entrance and exit openings, and blower means for exhausting air from each of said enclosures.

11. An apparatus for heat treating a running yarn, and comprising a yarn treatment chamber including an entrance opening in one end wall, an exit opening in the opposite end wall, and means for heating the interior thereof, yarn conveyor means extending through said chamber and through said entrance and exit openings for advancing a running yarn therealong and while supporting the yarn in downwardly hanging, relaxed helically arranged loops, said conveyor means including two endless belts having laterally spaced apart upper runs, and means for advancing the belts in unison, and such that a running yarn is adapted to be helically wound onto the conveyor means at a yarn receiving zone which is upstream of said entrance opening and withdrawn therefrom downstream of said exit opening, and belt guide means operatively associated with said two upper runs for providing a predetermined relatively small lateral spacing between the upper runs adjacent said entrance opening and a gradually increasing lateral spacing of such runs through said chamber and to a point adjacent said exit opening, whereby such runs move laterally with respect to the upper portions of the supported loops of yarn during movement through said chamber and thereby avoid the formation of permanent kinks in such loops of yarn.

12. The apparatus as defined in claim 11 wherein said belt guide means further comprises means for maintaining the upper runs of said two belts in a relatively wide spacing adjacent said yarn receiving zone, and such that the lateral spacing decreases as they move toward said entrance opening, and said apparatus further comprises yarn engaging means mounted between said yarn receiving zone and said entrance opening for supporting the loops so as to prevent any significant drape in that portion of the loops extending between said upper runs.

13. The apparatus as defined in claim 12 wherein said yarn engaging means comprises a pair of longitudinally extending surfaces disposed between said upper runs so as to contact that portion of the loops extending between such upper runs, and with the surfaces diverging from each other as they approach said entrance opening.

14. The apparatus as defined in claim 11 wherein said belt guide means includes a pair of guide pulleys positioned adjacent each of said entrance and exit openings with the pulleys of each pair engaging respective ones of said upper runs, and a roller mounted to said chamber and disposed along the upper edge of said exit opening for preventing the upper runs from engaging such upper edge.

15. A method for efficiently heat treating a running yarn and comprising the steps of forming a running yarn into downwardly hanging helically arranged loops, conveying the thus formed loops through a heated treatment chamber and through aligned entrance and exit openings in opposite end walls of the chamber, while directing heated air and steam into contact with all portions of the loops as they are conveyed through the treatment chamber, and while supporting and lifting the lower portions of the loops at least as they move through the entrance and exit openings of the chamber to reduce the vertical dimension of the loops without reducing the circumferential extent thereof, with the entrance and exit openings being sized to closely conform to the dimensions of the loops passing therethrough so as to minimize the loss of heat from the interior of the chamber and the entry of outside air, exhausting air from an area surrounding the outside of each of said entrance and exit openings so as to effectively preclude the entrance of outside through said openings and into said chamber, and directing heated air and steam into contact primarily only with the lower portions of the yarn loops as they move through each of said entrance and exit openings to thereby neutralize the cooling effect of any outside air passing into the chamber through the lower portions of such openings.

16. The method as defined in claim 15 comprising the further steps of supporting the upper portions of the loops at two laterally spaced points, and increasing the lateral separation of the support points while the loops are conveyed through the heated treatment chamber so that the support points move laterally with respect to the upper portion of the loops and thereby avoid the formation of permanent kinks in the yarn.

17. A method for efficiently heat treating a running polymeric yarn and comprising the steps of forming the running yarn into downwardly hanging helically arranged loops, and with the upper portion of the loops being supported at two laterally spaced points by the upper runs of a pair of endless belts, and advancing the endless belts so as to convey the thus formed loops through a heated treatment chamber, while gradually increasing the lateral separation of the upper runs of the belts and so that the upper runs move laterally with respect to the upper portion of the loops and thereby avoid the formation of permanent kinks in the yarn.

18. The method as defined in claim 17 comprising the further step of initially decreasing the lateral separation of the upper runs of said belts prior to entering the treatment chamber, while supporting the loops so as to prevent any significant drape in that portion of the loops extending between said upper runs.

19. An energy efficient apparatus for heat treating a running yarn, and comprising a yarn treatment chamber, including an entrance opening in one end wall, an exit opening in the opposite end wall, and means for heating the interior thereof, exhaust enclosure means mounted immediately outside each of said entrance and exit openings, and blower means for exhausting air from each of said enclosure means, yarn conveyor means extending through said chamber, through said entrance and exit openings, and through each of said exhaust enclosure means for advancing a running yarn therealong and while supporting the yarn in downwardly hanging, relaxed helically arranged loops, steam jacket means mounted immediately adjacent each of said entrance and exit openings of said chamber for directing heated air and steam across the associated opening to minimize the cooling effect of outside air passing into said chamber, and such that upon entering the chamber the advancing loops first pass through the associated exhaust enclosure means and then through the entrance opening and the associated steam jacket means, and upon leaving the chamber the loops first pass through the associated steam jacket means and the exit opening and then through the associated exhaust enclosure means, and yarn loop support means underlying said conveyor means at least adjacent said entrance openings for supporting and lifting the lower portions of the loops as they move through said entrance opening to thereby reduce the vertical dimension of the loops without reducing the circumferential extent thereof, and so that the vertical dimension of said entrance opening is not substantially greater than the vertical dimension of the loops as they move therethrough to thereby minimize the loss of heat through the opening and the entry of outside air into the chamber.

20. The apparatus as defined in claim 19 wherein each of said steam jacket means comprises a steam jacket section mounted along the bottom edge of the associated opening. with each steam jacket section being perforated on the upper surface thereof so that the heated air and steam is directed upwardly and primarily contacts the lower portions of the yarn loops passing therethrough.

21. The apparatus as defined in claim 19 further comprising yarn loop support means underlying said conveyor means adjacent said exit opening for supporting and lifting the lower portions of the loops as they move through said exit opening to thereby reduce the vertical dimension of the loops without reducing the circumferential extent thereof, and so that the vertical dimension of each of said entrance and exit openings is not substantially greater than the vertical dimension of the loops as they move therethrough to thereby minimize the loss of heat through the openings and the entry of outside air into the chamber.

* * * * *

UNITED STATES PATENT AND TRADEMARK OFFICE

CERTIFICATE OF CORRECTION

PATENT NO. : 4,513,514

DATED : April 30, 1985

INVENTOR(S) : Erwin Steiner

It is certified that error appears in the above-identified patent and that said Letters Patent is hereby corrected as shown below:

Claim 15, Column 11, Line 36, after "outside" insert -- air --.

Signed and Sealed this

*Twenty-seventh* Day of *August 1985*

[SEAL]

*Attest:*

DONALD J. QUIGG

*Attesting Officer*

*Acting Commissioner of Patents and Trademarks*